United States Patent [19]

Valkonet

[11] Patent Number: 4,969,173

[45] Date of Patent: Nov. 6, 1990

[54] X-RAY TUBE COMPRISING AN ANNULAR FOCUS

[75] Inventor: Lourens Valkonet, Eindhoven, Netherlands

[73] Assignee: U.S. Philips Corporation, New York, N.Y.

[21] Appl. No.: 136,170

[22] Filed: Dec. 18, 1987

[30] Foreign Application Priority Data

Dec. 23, 1986 [NL] Netherlands ..... 8603264

[51] Int. Cl.[5] ..... H01J 35/06

[52] U.S. Cl. ..... 378/136; 378/140; 378/143

[58] Field of Search ..... 378/119, 121, 124, 135–138, 378/140–141, 143–144, 161

[56] References Cited

U.S. PATENT DOCUMENTS

| | | | |
|---|---|---|---|
| 1,310,714 | 7/1919 | Rider | 378/135 |
| 1,684,263 | 9/1928 | Coolidge | 378/138 |
| 2,291,948 | 8/1942 | Cassen | 378/137 |
| 2,482,275 | 9/1949 | Horsley | 378/136 |
| 2,679,017 | 5/1954 | Rogers et al. | 378/140 |
| 2,896,105 | 7/1959 | Hoseman | 378/140 |
| 3,176,137 | 3/1965 | Hofmann et al. | 378/141 |
| 3,239,706 | 3/1966 | Farrell et al. | 378/140 |
| 3,517,195 | 6/1970 | Leavitt | 378/124 |
| 3,836,803 | 9/1974 | Dietz et al. | 378/144 |
| 4,034,251 | 7/1977 | Haas | 378/140 |
| 4,250,425 | 2/1981 | Gabbay et al. | 378/137 |
| 4,292,563 | 9/1981 | Gabbay et al. | 378/124 |
| 4,373,144 | 2/1983 | Franke | 378/136 |
| 4,583,243 | 4/1986 | Diemer et al. | 378/121 |
| 4,679,219 | 7/1987 | Ozaki | 378/135 |
| 4,731,804 | 3/1988 | Jenkins | 378/140 |
| 4,788,705 | 11/1988 | Anderson | 378/144 |

FOREIGN PATENT DOCUMENTS

| | | | |
|---|---|---|---|
| 0030453 | 6/1981 | European Pat. Off. | 378/137 |

*Primary Examiner*—Craig E. Church
*Attorney, Agent, or Firm*—Robert J. Draus

[57] ABSTRACT

The electron-emissive element in an X-ray tube is constructed so as to be loop-shaped so that an electron target which is also loop-shaped can be formed on an anode. Notably for target transmission tubes having an integrated window-anode element, a substantial reduction of the window temperature can thus be achieved. Inter alia because of the lower temperature gradients, the window can be constructed to be thinner; however, its service life is substantially prolonged and the radiation efficiency of the tube is increased.

5 Claims, 1 Drawing Sheet

X-RAY TUBE COMPRISING AN ANNULAR FOCUS

BACKGROUND OF THE INVENTION

The invention relates to an X-ray tube comprising an anode and a cathode which are accommodated in an envelope comprising a high-voltage connection and an exit window.

An X-ray tube of this kind is known from EP 168.641. An X-ray tube described therein comprises a cathode provided with a filament in the form of a flat helix and also comprises a conical anode whose cone axis extends transversely of the center of the helical filament. In order to avoid excessively high temperatures in a central part of the anode, the temperature of an oppositely situated part of the filament is adjusted to a value which is lower than the temperature of the peripheral part of the helix. Even though the central anode temperature can be reduced by means of such a construction, it has been found that for many applications or anode constructions this solution is inadequate to ensure a comparatively long service life of the X-ray tube.

SUMMARY OF THE INVENTION

It is an object of the invention to mitigate these drawbacks; to achieve this, an X-ray tube of the kind set forth in accordance with the invention is characterized in that the cathode comprises a substantially closed, loop-shaped electron-emissive element in order to form a loop-shaped electron target on the anode.

Because a loop-shaped focal path is formed on the anode in an X-ray tube in accordance with the invention, an optimum value can be laid down for the central anode temperature by choosing an appropriate position of the focal path in dependence of the heat transport in the anode.

In a preferred embodiment, the anode forms part of a radiation exit window for the tube and the position of the loop-shaped electron target thereon is chosen so that an attractive compromise is obtained between the heat applied and the heat to be dissipated via the window periphery in order to obtain a desired temperature for a central window part. In principle it will be ensured that the temperature variation across the window in the radial direction is comparatively uniform near the central part. Notably for high temperatures the heat radiation of the window is also important for the optimum equilibrium. In an X-ray tube of this kind notably the seal between the window plate and the tube wall, and possibly the tube wall as such, is adapted to an optimum compromise. At this area it is more important that the heat dissipation via the window periphery is optimized, because the better the dissipation, the further the loop-shaped target can be situated from the central part so that, ignoring other parameters, a lower temperature can be realized at that area.

In a further preferred embodiment, the thickness of the exit window is adapted to the maximum local window temperature then occurring, or to the smaller temperature gradients thus realized, and an X-ray tube is obtained which comprises a substantially thinner window, without reducing the service life, so that the radiation yield of the tube is substantially increased notably for soft radiation.

A window plate in an X-ray tube in accordance with the invention consists of, for example beryllium and is coated on the inner side of the tube with a layer of anode material, for example chromium, rhodium, scandium, etc.. The thickness of the beryllium plate amounts to, for example only approximately 100/μm and the thickness of the (layer of) anode material is adapted to the electron velocities occurring and also to the nature of the desired radiation; for example, it amounts to a few/μm. Viewed in the thickness direction, layers of different anode materials may also be provided, for example as described in European Patent Application NO. 127.230.

In a further preferred embodiment the transverse dimension, and hence the location of the anode target in the tube, can be adjusted from the outside in order to obtain an optimum value. The anode may again comprise a plurality of focal paths of different anode materials which succeed one another in a loop-like manner. The adjustment is realized notably by means of an electrostatic lens effect and the anode material for the hardest radiation is situated at the edge of the anode which usually also forms part of an exit window. If potential variations are not desirable in the tube, a mechanical adjustment can also be used; in that case, for example the position of a loop-shaped filament as the emissive element can be axially situated in a loop-shaped electrode.

BRIEF DESCRIPTION OF THE DRAWING

Some preferred embodiments in accordance with the invention will be described in detail hereinafter with reference to the drawing. Therein.

DESCRIPTION OF THE PREFERRED EMBODIMENT

Figure 1:
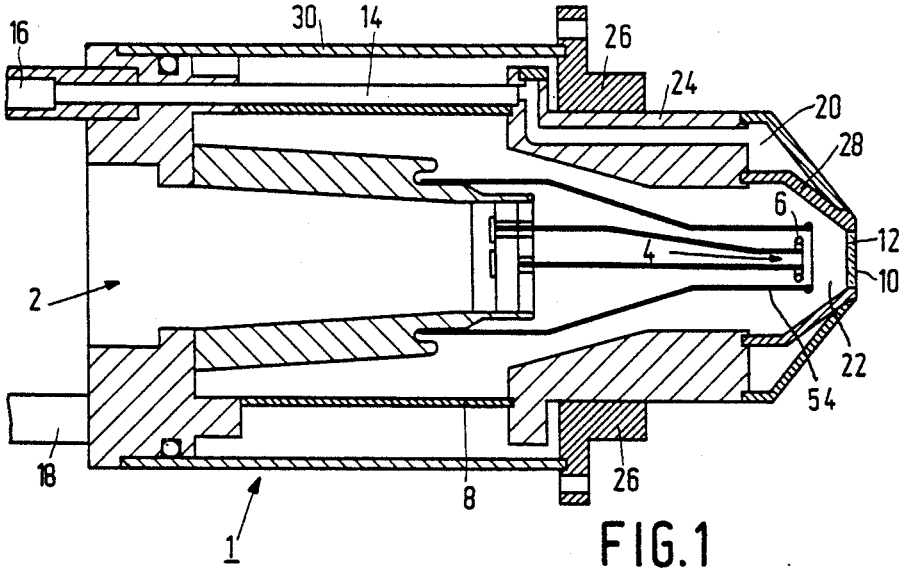
FIG. 1 shows an X-ray tube in accordance with the invention in the form of a target transmission tube.

An X-ray tube as shown in FIG. 1 comprises an envelope 1 with a conical ceramic base 2, a cathode 4 with an emissive element in the form of a filament 6, a cylindrical wall 8 and an exit window 10. An anode 12 is provided in the form of a layer of anode material on an inner side of the exit window. The anode consists of, for example chromium, rhodium, scandium or another anode material. The thickness of the layer is adapted to the desired radiation, the radiation absorption properties of the material, notably to the electron absorption thereof, and to the desired high voltage for the tube. A chromium layer and a scandium layer have a thickness of, for example 1/μm and a rhodium layer has a thickness of, for example 2.5/μm.

In the envelope there is provided a cooling duct 14 with an inlet 16, an outlet 18 and a flow duct 20 which encloses the exit window.

A high-voltage connector which is preferably made of rubber can be inserted into the base 2. A high-voltage connector of this kind is connected to a high-voltage cable, supply leads for the filament and supply leads for any further electrodes to be arranged in an anode-cathode space 22. Around the envelope there is provided a mounting bush 24 with a mounting flange 26 and an additional radiation screen 28 which also serves to bound the flow duct 20. Around the tube there is also arranged a thin-walled mounting bush 30 in which the cooling ducts are accommodated and which can also have a temperature-equalizing effect.

Figure 2:
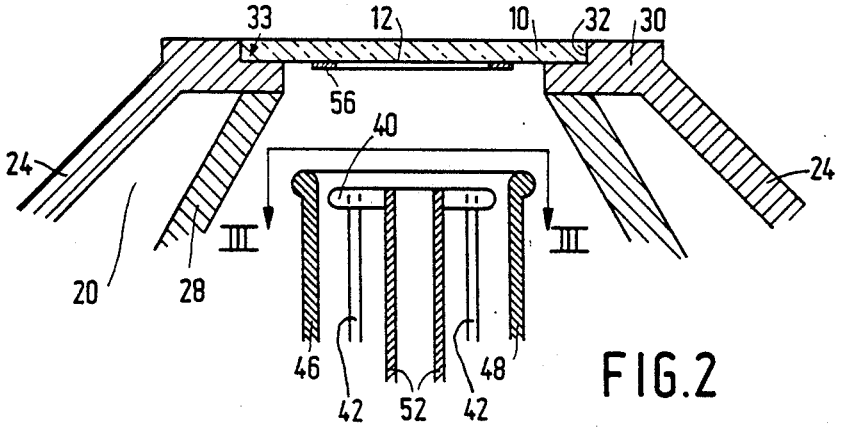
FIGS. 2 and 3 show more detailed representations of a cathode-anode geometry thereof.

FIG. 2 shows the window-anode-cathode unit at an increased scale. The window 10 is provided in the envelope, for example by diffusion as described in U.S. Pat. No. 4,431,709. A window support 30 of the present embodiment comprises a supporting ring 33 which is mounted on a conical part of the tube wall 24, the window plate 10 being arranged in a recess 32 in said supporting ring. Suitable dissipation of heat is ensured for the window when the supporting ring 32 bounds the flow duct 20 and is in suitable thermal contact with the envelope 24 and the screen 28. A comparatively thick construction of the elements 24 and 28 stimulates the dissipation of heat as well as the absorption of radiation.

On an inner side of the window 10 there is provided the anode 12, for example in the form of a vapour-deposited thin layer of anode material. In addition to vapour-deposition, sputtering or electroplating are also suitable techniques for the deposition of the anode layer. The anode customarily operates substantially at ground potential, so & that no problems will be encountered as regards the electrical insulation of the comparatively thin beryllium window.

Figure 3:
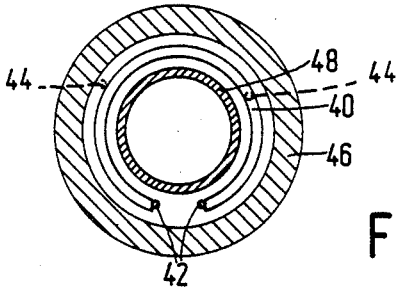

In the present embodiment, the electron-emissive element 6 is arranged in the cathode-anode space at a comparatively small distance from the anode. The emitter is shaped as a loop-shaped filament, a preferred shape being shown in FIG. 3. The filament of the present embodiment comprises a loop-shaped emissive wire 40 and input and output leads 42. The filament is preferably freely suspended; whenever desired, supports 44 may be provided. For the sake of homogeneity of the radiation, the supports should dissipate as little heat as possible and should disturb as little as possible a potential field prevailing near the emitter. Around the emitter there is arranged a cylindrical electrode 46 and an electrode sleeve 48 is arranged within the loop of the emitter. Via connections 50 and 52, the electrode and the electrode bush can be connected, for example to connection leads in the high-voltage connector. In addition to the transverse dimension of the loop, the transverse dimension of a loop-shaped focus 56 to be formed can thus be varied by varying either the potentials of the electrode sleeves or by varying the height position of at least one thereof. The annular focus can also be focussed on the anode layer to a greater or lesser extent by optimizing the positioning and potentials of the sleeves.

What is claimed is:

1. An x-ray tube comprising an envelope; a window through which x-rays produced inside the envelope are transmitted to the exterior of the envelope; and cooling means for transferring heat away from said window during operation of the tube; said envelope containing:

a. an x-ray producing anode layer disposed on a surface of the window, said layer being optimally positioned to effect heat transfer to said cooling means;

b. a loop-shaped electron-emitting cathode disposed for emitting electrons toward the anode layer; and c. electrode means disposed adjacent the cathode for focusing electrons emitted by the cathode into an annulus of controllable width on the anode layer.

2. An x-ray tube as in claim 1 wherein the electrode means comprises first and second coaxial tubular electrodes, and the cathode is disposed between said first and second electrodes.

3. An X-ray tube as in claim 1 or 2 wherein the electrode means is positioned optimally to effect said focusing.

4. An X-ray tube as in claim 1 or 2 where electrical potentials applied to the electrode means are optimized to effect said focussing.

5. An X-ray tube as in claim 1 or 2 where the anode layer consists essentially of a material from the group chromium, rhodium and scandium.

* * * * *